US012134415B2

(12) United States Patent
Iusto

(10) Patent No.: US 12,134,415 B2
(45) Date of Patent: Nov. 5, 2024

(54) COMMUNICATION NETWORK ARCHITECTURE FOR TRAINS

(71) Applicant: HITACHI RAIL STS S.p.A., Naples (IT)

(72) Inventor: Giovanni Iusto, Naples (IT)

(73) Assignee: HITACHI RAIL STS S.p.A., Naples (IT)

( * ) Notice: Subject to any disclaimer, the term of this patent is extended or adjusted under 35 U.S.C. 154(b) by 799 days.

(21) Appl. No.: 17/244,187

(22) Filed: Apr. 29, 2021

(65) Prior Publication Data

US 2021/0339778 A1 Nov. 4, 2021

(30) Foreign Application Priority Data

Apr. 30, 2020 (IT) ..... 102020000009592

(51) Int. Cl.
*B61L 15/00* (2006.01)

(52) U.S. Cl.
CPC ..... *B61L 15/0018* (2013.01); *B61L 15/0054* (2013.01); *B61L 15/0072* (2013.01)

(58) Field of Classification Search
CPC ..... B61L 15/0018; B61L 15/0054; B61L 15/0072; B61L 15/0063; B61L 15/0036
See application file for complete search history.

(56) References Cited

U.S. PATENT DOCUMENTS

| | | | | |
|---|---|---|---|---|
| 2017/0139388 | A1 | 5/2017 | Sachs et al. | |
| 2019/0351924 | A1* | 11/2019 | Bozzo | B61L 27/70 |
| 2020/0021397 | A1* | 1/2020 | Fruehling | H04L 47/34 |
| 2021/0009174 | A1* | 1/2021 | Xu | H04L 41/0663 |

FOREIGN PATENT DOCUMENTS

| | | |
|---|---|---|
| CN | 110 008 022 | 7/2019 |
| EP | 2 236 999 | 10/2010 |
| EP | 3 388 904 | 10/2018 |

OTHER PUBLICATIONS

Ceccarelli et al, A. A Resilient SIL 2 Driver Machine Interface for Train Control Systems, Google Scholar, IEEE Third International Conference on Dependability of Computer Systems DepCoS-RELCOMEX, Jun. 2008, pp. 365-374. (Year: 2008).*

* cited by examiner

*Primary Examiner* — Russell Frejd
(74) *Attorney, Agent, or Firm* — Leason Ellis LLP

(57) ABSTRACT

A communication architecture of a train in which at least one central processing unit arranged in a train carriage is interconnected through a communication network of the train with a plurality of peripheral processing units. The central processing unit is provided on a single board with: a processor designed to process data associated with an SIL 0 safety level; a coprocessor designed to process data associated with an SIL 1-SIL 2 safety level; an internal bus built on the board and configured to allow a two-way data communication between the processor and the coprocessor; an interface for the communication network of the train. The coprocessor is designed to be programmed in a reconfigurable manner with a software that allows the validation and encoding of data coming from the processor according to a safety protocol.

12 Claims, 8 Drawing Sheets

COMMUNICATION NETWORK ARCHITECTURE FOR TRAINS

CROSS-REFERENCE TO RELATED APPLICATIONS

This patent application claims priority from Italian patent application no. 102020000009592 filed on Apr. 30, 2020, the entire disclosure of which is incorporated herein by reference.

FIELD OF THE INVENTION

This invention relates to a communication network architecture for trains.

BACKGROUND OF THE INVENTION

As is well known, the different systems and sub-systems on a train are interconnected through a Train Communication Network (TCN) that enables data exchange between these devices.

Each train function associated with these devices must be distinguished by a Safety Integrity Level (SIL) that can vary from 0 (where the associated function is considered to have no impact on safety) to 4 (which is the maximum level of impact on safety).

The Safety Integrity Level (SIL) is also defined as the level of risk reduction ensured by a Safety Instrumented Function (SIF) as part of Functional Safety Management in the process industry. The requirements associated with a given SIL may change depending on the reference standard. According to the IEC 61508 and IEC 61511 standards of the International Electrotechnical Commission (IEC), 4 possible SIL levels are defined, from SIL1 (least reliable) to SIL4 (most reliable), which are determined by a qualitative or quantitative analysis.

Functions associated with SIL level 0 require an ordinary development, validation, and certification process, while functions distinguished by SIL levels 1-4 require more and more onerous processes.

A large part of the cost of designing the architecture of a communication network lies in the validation and certification of security functions.

For example, European Patent EP-3.388.904 describes a train communication network architecture wherein a first processor (CPU I) is used that processes only data associated with a safety level greater than zero, and a second processor (CPU II) that processes only data associated with a safety level of zero. In this way, secure and non-secure functions are kept separate. The first and the second processors communicate on one side, through an interface that creates separate channels, with Host devices. The first and the second processors also communicate, on a second side, with ports connected with respective Ethernet communication lines, on which data with safety levels and data without safety levels are transmitted separately.

The purpose of this invention is to provide a train communication network architecture wherein the validation and certification operations of the safety functions have a lesser impact in terms of time and cost, using a different and simpler architecture than that of the patent referred to.

SUMMARY OF THE INVENTION

The above-mentioned purpose is achieved with this invention in that it relates to a communication network architecture for trains of the type described in claim 1.

BRIEF DESCRIPTION OF THE DRAWINGS

For a better understanding of this invention, an embodiment will be provided that is illustrated in the accompanying drawings, which represent a preferred, limiting embodiment thereof wherein.

DETAILED DESCRIPTION OF THE EMBODIMENT OF THE INVENTION

Figure 1A:
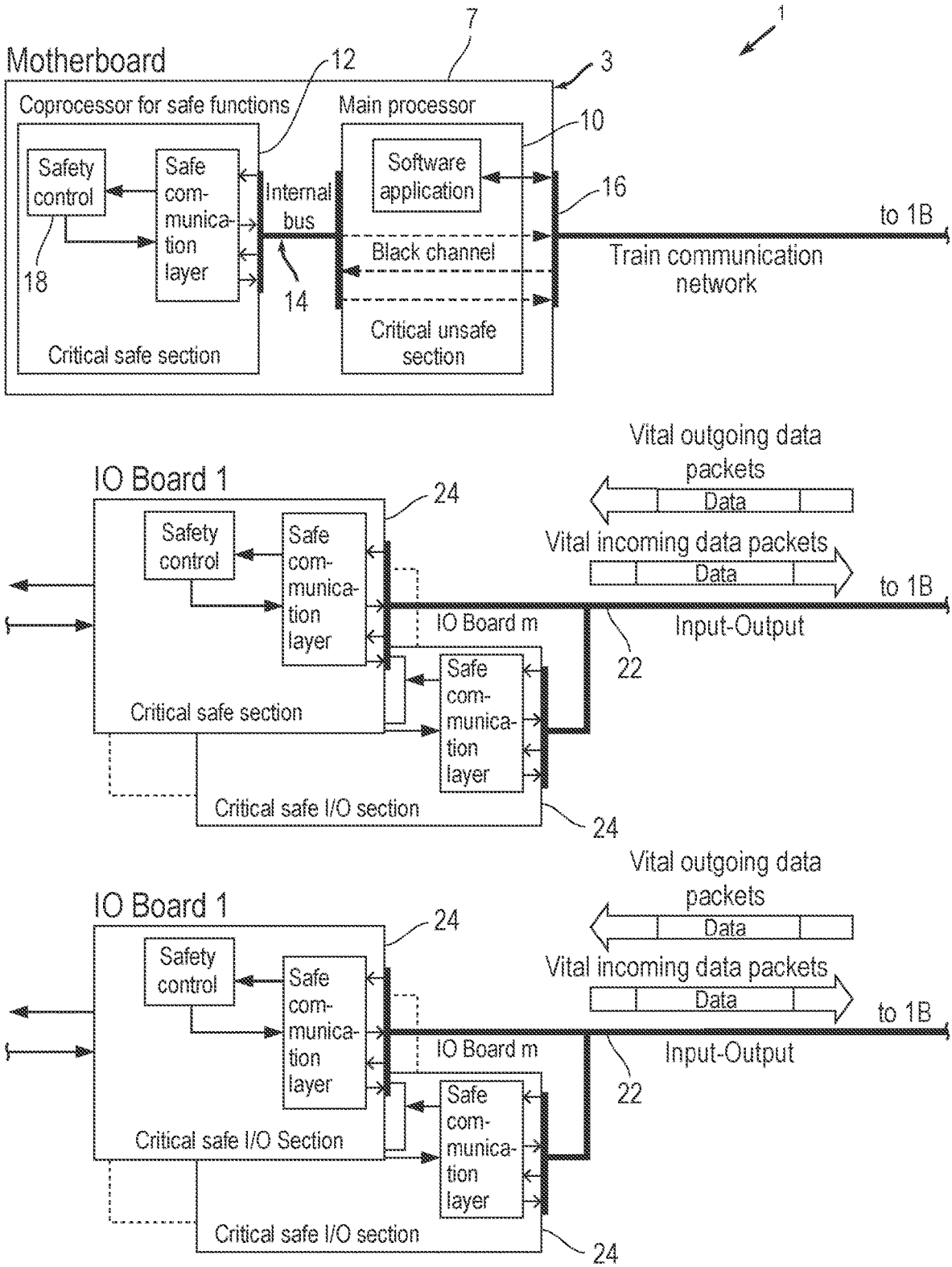
FIGS. 1A and 1B schematically illustrate a communication network for trains produced according to the precepts of the present invention.

The number 1 identifies a train communication network architecture produced according to the present invention.

The architecture comprises at least one central processing unit 3 (Main Board) arranged in a train carriage and interconnected via a communication network 5 (of a known type) of the train with a number of peripheral processing units 6 (I/O Collector Board). The communication network 5 extends along the carriages (typically from two to twelve) that form a railway convoy (not illustrated). Each peripheral processing unit 6 is preferably, but not exclusively, arranged on a respective carriage.

The central processing unit 3 is made from a single board 7 comprising:

- a main processor 10 designed to process data associated with a zero safety level, SIL 0;
- a coprocessor 12 (Safe Function Coprocessor) designed to process only data associated with an SIL 1 or an SIL 2 safety level;
- an internal bus 14 built on the board 7 and configured to enable two-way data communication between the processor 10 and the coprocessor 12;
- an interface 16 designed to enable connection between the main processor 10 and the external communication network 5 of the train. The external communication network 5 of a known type (e.g. MVB, WTB, Ethernet) is designed to transmit data associated with a SIL 0 safety level and can also be used to transmit data packets encoded with SIL 1 or SIL 2 safety levels, through the known technique of the "black channel", which consists in using a Standard communication channel to also transmit SIL 1 or SIL 2 data, applying thereon, in the coprocessors (12), the functions for implementing a safety protocol, in the boards (7) of the units (3, 6) at the ends of the "black channel".

The coprocessor 12 is designed to be programmed in a reconfigurable manner with a software 18 that enables the validation and encoding of data coming from the main processor 10 according to a safety protocol of a known type.

The coprocessor 12 is also configured to transfer the validated and encoded data to the main processor 10 for the subsequent transmission to the external communication network 5.

The architecture 1 highlighted above enables a segregation between data associated with a SIL1-SIL2 safety level and data with a minimum safety level (SIL0 level).

In this way, the validation and certification operations of the SIL 1-SIL 2 safety functions only involve the coprocessor 12. The functions of the main processor 10 may, therefore, be developed with the rules for the required functions with the SIL 0 safety level. The software that is installed on the processor 10 must meet less stringent criteria than the software 18 that is installed on the coprocessor 12. The same goes for the updates thereof. Thus, a hybrid solution is obtained wherein the cost of development and corrective and development maintenance of the board 7 is reduced compared to other known applications wherein all the components of the board must comply with the safety criterion equal to the maximum among those present in the functions.

Figure 1B:
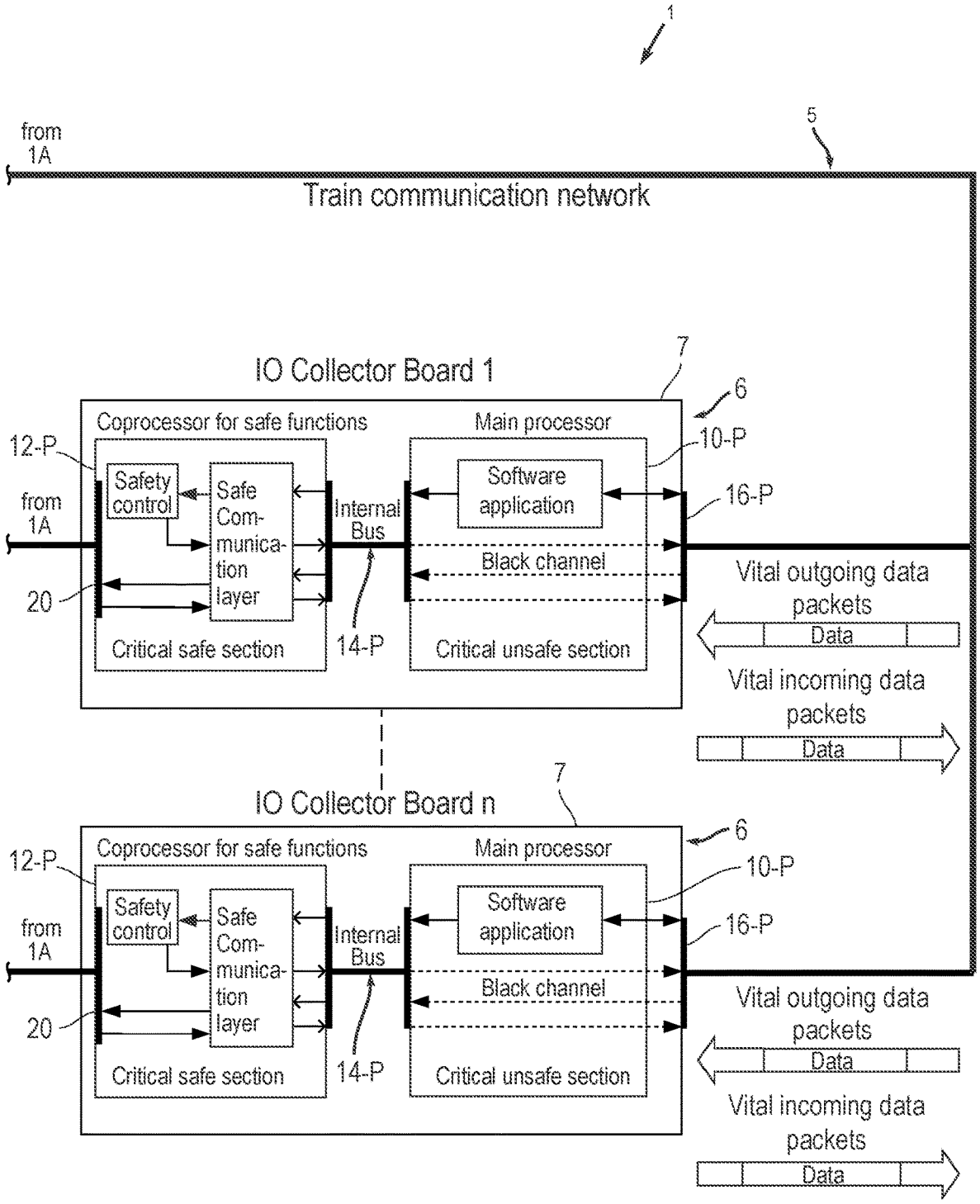

In the example illustrated in FIGS. 1A-1B, the peripheral processing units 6 have a structure similar to that of the central processing unit 3 and comprise, on a single board 7:

- a main processor 10 designed to process data associated with a zero safety level;
- a coprocessor 12-*p* (Safe Function Coprocessor) designed to process only data associated with an SIL 1 or an SIL 2 safety level;
- an internal bus 14-*p* built on the board 7 and configured to enable two-way data communication between the processor 10-*p* and the coprocessor 12-*p;*
- an interface 16-*p* designed to enable the connection between the main processor 10-*p* and the processor 10 through the external communication 5 of the train.

The processor 10 of the central communication unit 3 is configured so that:

- if the processor 10 receives data associated with a safety level of 1, or even 2, encoded within a protocol defined as safe (SIL 1, SIL 2), this data is transmitted to the coprocessor 12 without any processing of said data. In this way, the data is only transferred from the processor 10 to the coprocessor 12, which verifies the validity of the received data, processes the safety functions, packages the data within a safety protocol, and transmits it to the train communication network 5 via the processor 10 (black channel). In the case of functions processed by the processor 10 that contain commands that impact the safety functions, the processor 10 transfers the command data to the coprocessor 12, which validates the command data safely, packages the data within a safety protocol and transmits it to the train communication network 5 via the processor 10 (black channel).

If the processor 10 processes commands that only impact on the functions with SIL 0 safety level, such data is directly validated and processed by the processor 10 before being transmitted to the communication network 5, without the need to implement a safety protocol.

The coprocessor 12 is designed to be programmed in a reconfigurable manner with the software 18 that enables the validation and encoding of data coming from the processor 10 according to a safe protocol. In addition, the coprocessor 12 is configured to transfer the validated and encoded data to the processor 10 for the subsequent transmission on the train communication network 5.

As can be seen in the example of FIGS. 1A and 1B, the coprocessors 12-*p* of the peripheral units 6 are provided with an interface 20 for connection via a local bus 22 that has a simplified structure (in particular a BUS-CAN) with a number of INPUT/OUTPUT units 24 for the two-way data exchange between the INPUT/OUTPUT units 24 and the coprocessor 12-*p*.

The INPUT/OUTPUT units 24 are preferably, but not exclusively, provided with sensors designed to detect quantities and parameters detected on a respective carriage and are provided with an interface designed to transform the (digital/analogue) signal of the sensor into a format designed to be transmitted on the local bus 22.

In addition, the INPUT/OUTPUT units 24 are preferably, but not exclusively, provided with actuators designed to command electrical quantities and parameters on a respective carriage and are provided with an interface designed to transform the information transmitted on the local bus 22 into the (digital/analogue) signal of the actuator.

Figure 2A:
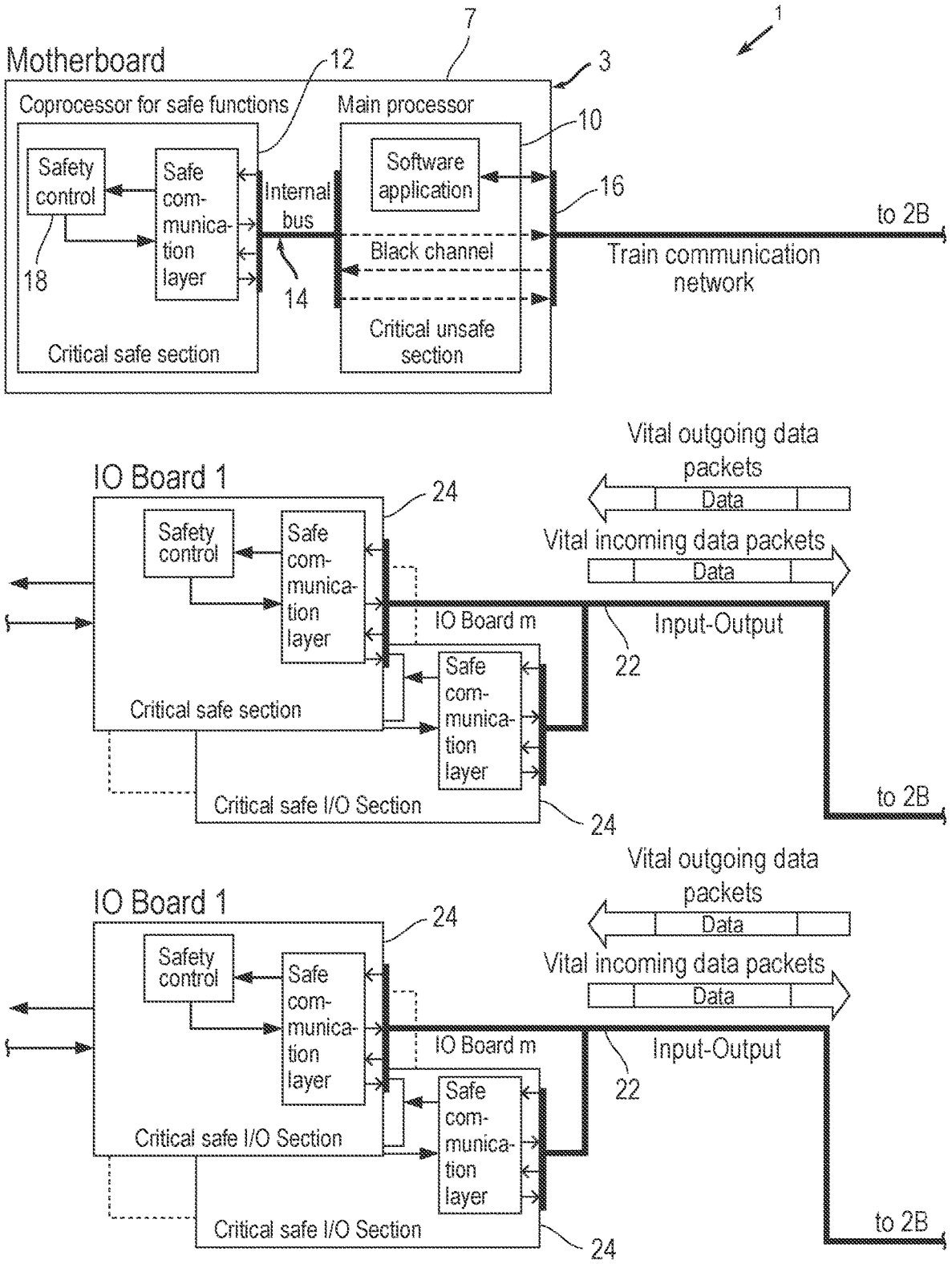
FIGS. 2A and 2B schematically illustrate a second embodiment of a communication network for trains produced according to the precepts of the present invention.
Figure 2B:
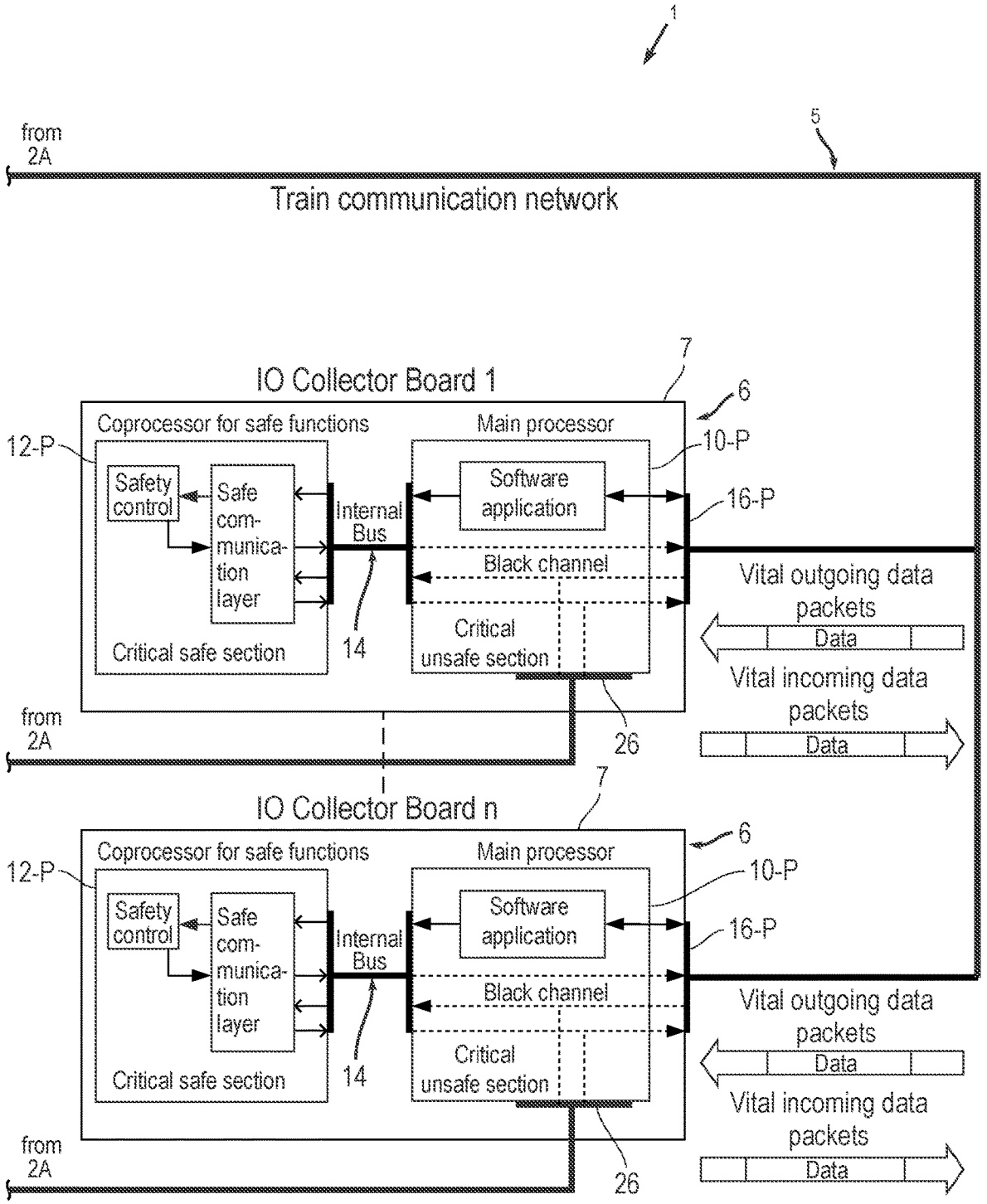

According to the variant provided in FIGS. 2A and 2B, the peripheral processing units 6 have the same structure as the peripheral processing units in FIGS. 1A and 1B.

In this case, the main processor 10-*p* is provided with a second interface 26 for connection to the local bus 22 that, in this way, directly connects the INPUT/OUTPUT units 24 with the main processor 10-*p*.

The main processor 10-*p* is configured to receive data with the safety levels SIL0 and SIL1 SIL2 from the INPUT/OUTPUT 24 units via the local bus 22. The data with the SIL1 SIL 2 safety levels is transmitted from the processor 10-*p* to the coprocessor 12-*p* without processing the data itself. In this way, the data is only transferred from the processor 10-*p* to the coprocessor 12-*p*, which checks the validity of the received data, validates it, packages the data within a secure protocol, and transmits it to the train communication network 5 through the processor 10-*p*.

Figure 3A:
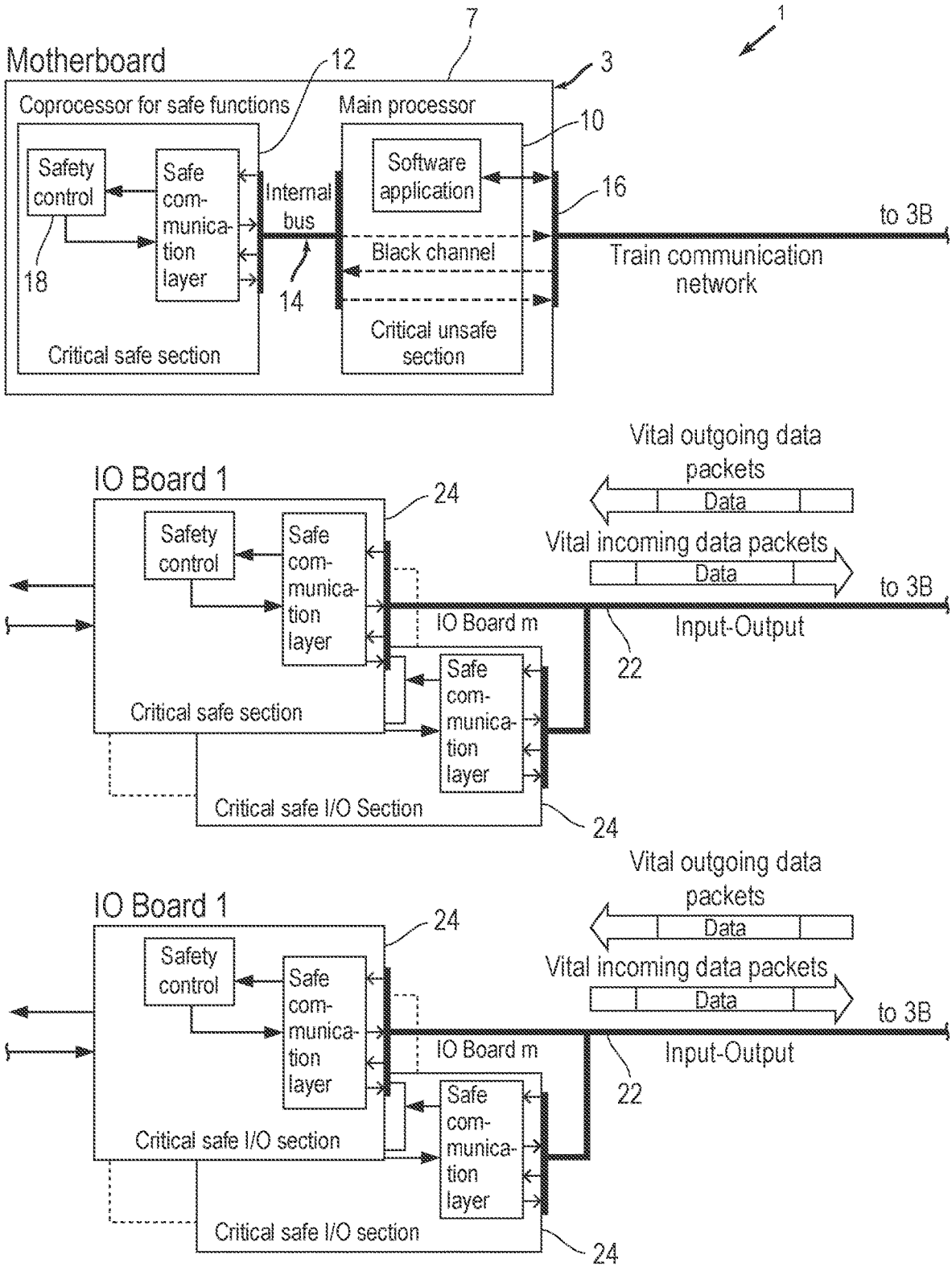
FIGS. 3A and 3B schematically illustrate a third embodiment of a communication network for trains produced according to the precepts of the present invention.
Figure 3B:
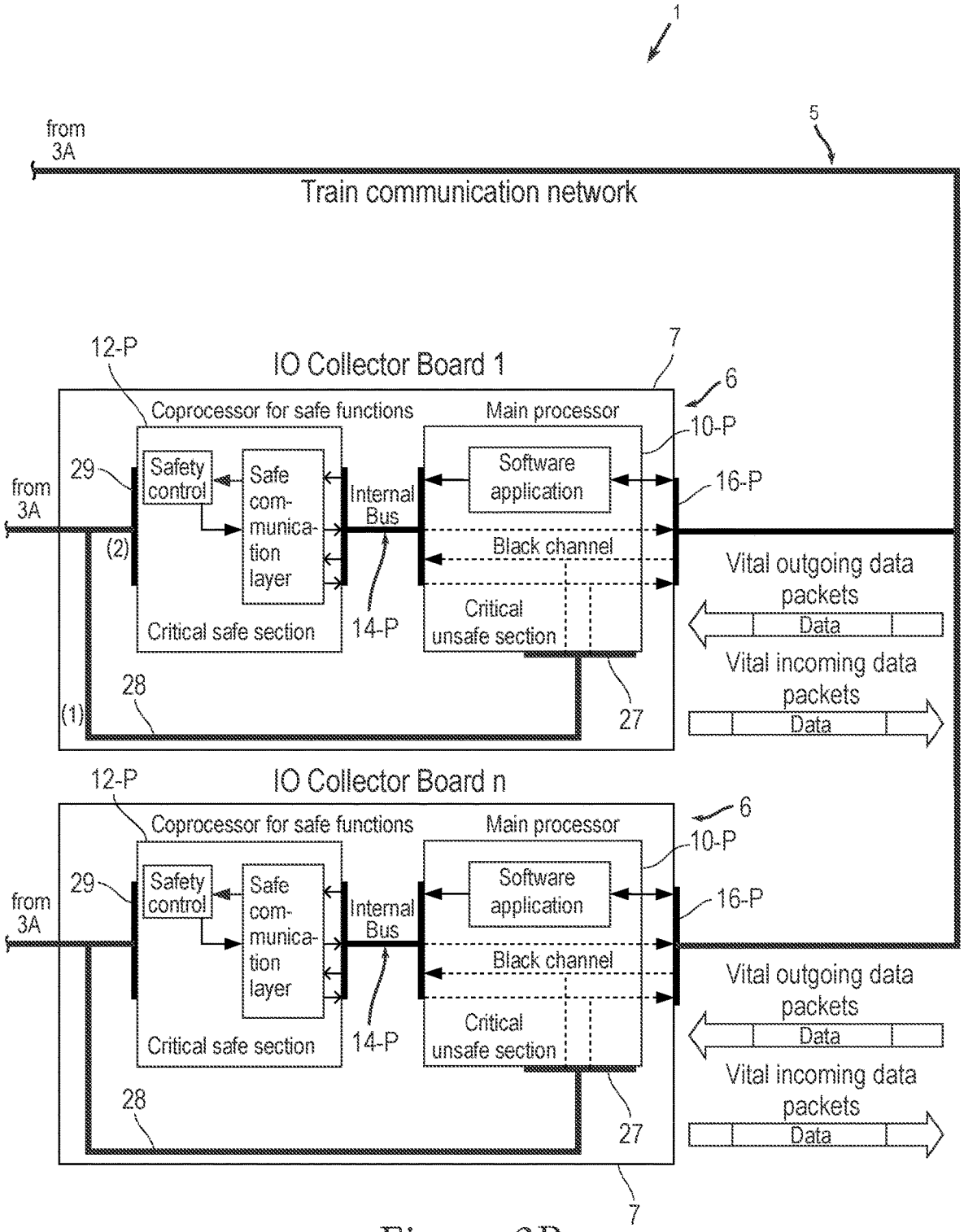

With reference to FIGS. 3A and 3B, the peripheral processing unit 6 comprises, on a single board 7:

- a main processor 10-*p* designed to process data associated with a zero safety level, SIL0;
- a coprocessor 12-*p* (Safe Function Coprocessor) designed to process only data associated with an SIL 1 or an SIL 2 safety level;
- a first internal bus 14-*p* built on the board 7 and configured to enable two-way data communication between the main processor 10-*p* and the coprocessor 12-*p;*
- a first interface 16-*p* designed to enable the connection between the main processor 10-*p* and the external communication network 5 of the train;
- a second interface 27 designed to enable the connection between the main processor 10-*p* and a second internal bus 28 communicating with a local bus 22 interconnected with a plurality of INPUT/OUTPUT units 24.

The coprocessor 12-*p* is provided with a third interface 29 communicating with the local bus 22 for two-way data exchange between the INPUT/OUTPUT units 24 and the coprocessor 12-*p* via the local bus 22.

The coprocessor 12-*p* is designed to process the data present on the local bus 22 and associated with an SIL1 or SIL2 safety level, encoded within a protocol defined as safe (SIL 1, SIL 2); this data, after its processing, is transferred via the processor 10-*p* to the train communication network 5.

The processor 10-*p* is designed to process the data present on the local bus 22 associated with a 0 safety level (SIL 0); this data, after its processing, is transferred directly to the train communication network 5.

Figure 4A:
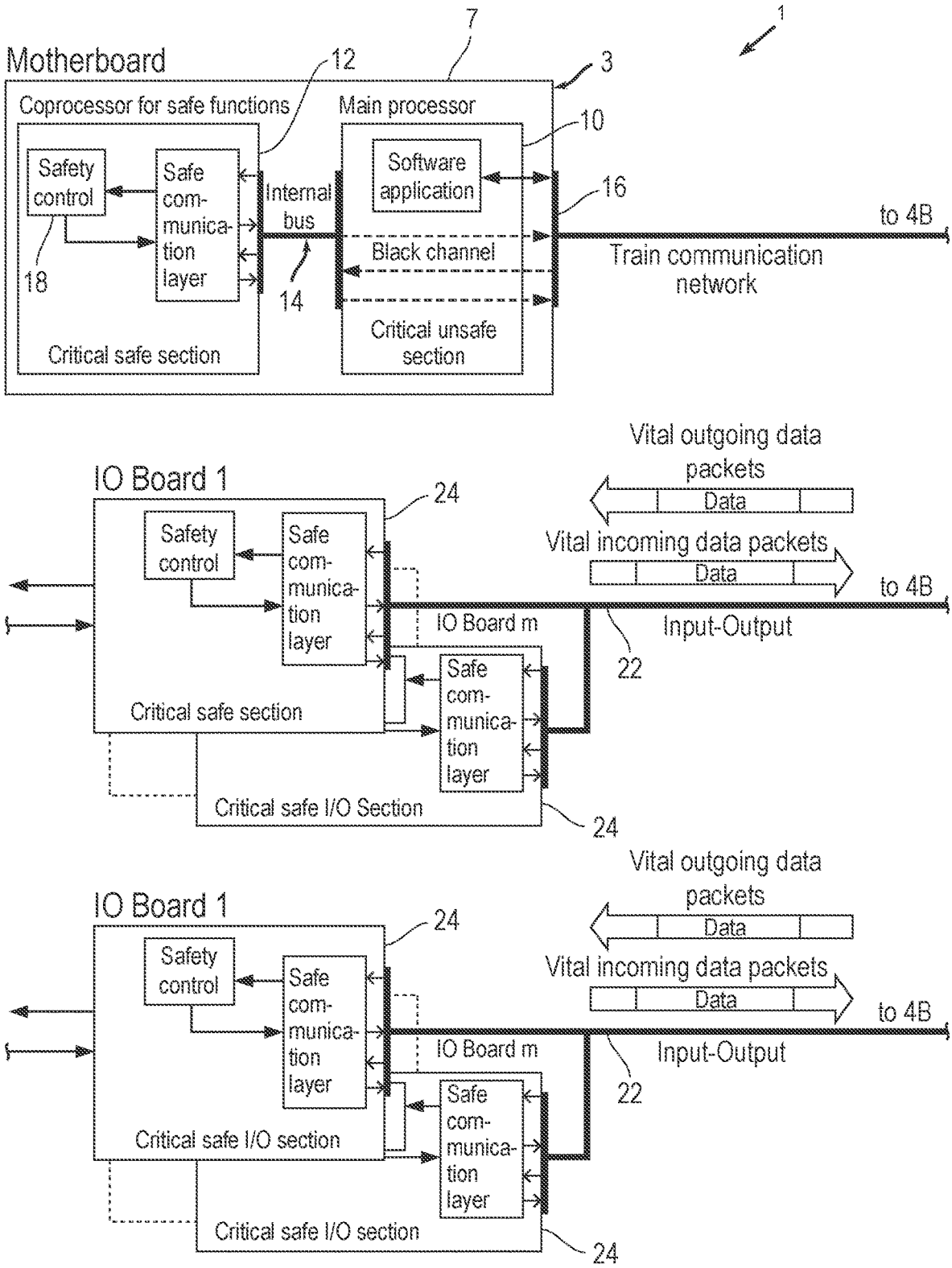
FIGS. 4A and 4B schematically illustrate a fourth embodiment of a communication network for trains produced according to the precepts of the present invention.
Figure 4B:
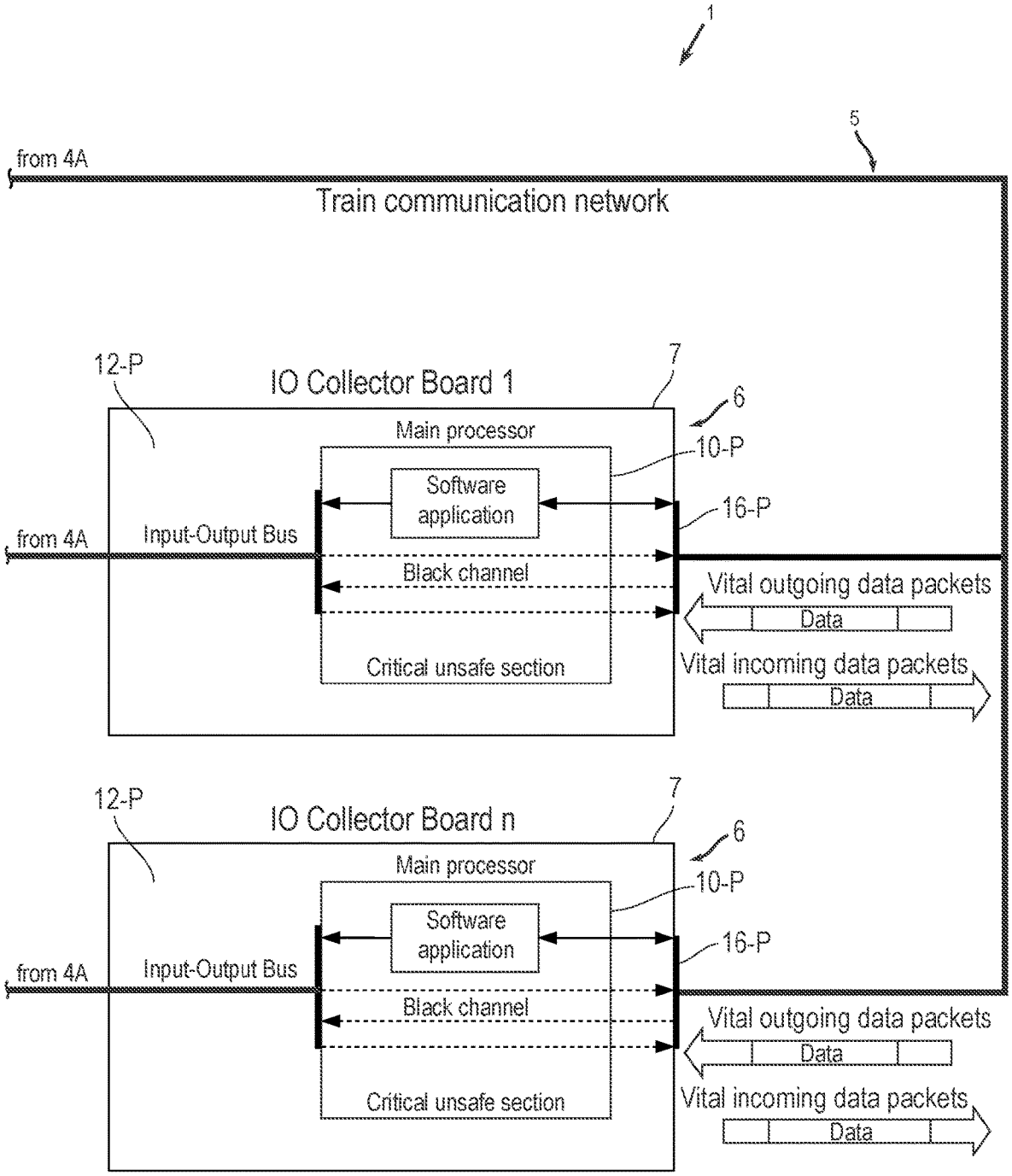

With reference to the embodiment in FIGS. 4A and 4B, the peripheral processing unit 6 comprises, on a single board 7:

- a single main processor 10-*p* designed to process data associated with a zero safety level, SIL0;
- a first interface 16-*p* designed to enable the connection between the main processor 10-*p* and the external communication network 5 of the train;

a further interface 30 designed to enable the connection between the main processor 10-*p* and a local bus 22 interconnected with a plurality of INPUT/OUTPUT units 24.

The processor 10-*p* is configured so that if it receives data associated with an SIL 1, SIL 2 safety level coming from the local bus 22, this data is transferred from the processor 10-*p* to the train communication network 5 and, thus, to the central processing unit 3.

The invention claimed is:

1. A communication architecture (1) of a train in which at least one central processing unit (3, Main Board) arranged in a train carriage is interconnected through a communication network (5) of the train with a plurality of peripheral processing units (6, I/O Collector Board); the communication network (5) of the train extends along the carriages that form a railway convoy; the communication network (5) of the train being able to transmit both data associated with an SIL 1 and an SIL 2 safety level and data with SIL 0 safety level;

wherein the central processing unit (3) is provided with a single board (7) which includes:

a processor (10) designed to process data associated with an SIL0 safety level;

a coprocessor (12) designed to process only data associated with an SIL1-SIL2 safety level;

an internal bus (14) built on the board (7) and configured to allow a two-way data communication between the processor (10) and the coprocessor (12);

interface means (16) designed to enable connection between said processor (10) and the communication network (5) of the train;

said coprocessor (12) being designed to be programmed in a reconfigurable manner with a software (18) that allows the validation and encoding of data coming from the processor (10) according to a safety protocol;

said coprocessor (12) also being configured to transfer the validated and encoded data to the processor (10) for the subsequent transmission on the communication network (5) of the train (5).

2. The communication network architecture (1) according to claim 1 wherein the processor (10) is configured so that:

if the processor (10) receives data associated with an SIL 1, SIL 2 safety level, encoded inside a protocol defined as safe, this data is transmitted to the coprocessor (12) without any data processing; the data is only transferred from the processor (10) to the coprocessor (12) which will verify the validity of the received data, validate it, package the data inside a safety protocol and transmit it to the train communication network (5) via the processor (10); in the case of functions processed by the processor (10) that contain commands which impact the safety functions, the processor (10) transfers the command data to the processor (12) which will validate the command data safely, package the data inside a secure protocol and transmit it to the train communication network (5) via the processor (10, black channel); and if the processor (10) processes commands that only impact on the functions with SIL 0 safety level, this data is directly sent to the train communication network (5), without the need for validation by the coprocessor (12) or implementation of a safety protocol.

3. The architecture according to claim 1, wherein the peripheral processing unit (6) comprises on a single board (7):

a main processor (10-*p*) designed to process data associated with a zero safety level, SIL 0;

a coprocessor (12-*p*, Safe Function Coprocessor) designed to process only data associated with an SIL 1 or an SIL 2 safety level;

a first internal bus (14-*p*) built on the board (7) and configured to enable a two-way data communication between the main processor (10-*p*) and the coprocessor (12-*p*);

a first interface (16-*p*) designed to enable the connection between the main processor (10-*p*) and the external communication network (5) of the train;

a second interface (27) designed to enable the connection between the main processor (10-*p*) and a second internal bus (28) communicating with a local bus (22) interconnected with a plurality of INPUT/OUTPUT units (24);

the coprocessor (12-*p*) being provided with a third interface (29) communicating with the local bus (22) for the two-way data exchange between the INPUT/OUTPUT units (24) and the coprocessor (12-*p*) via the local bus (22).

4. The architecture according to claim 3, wherein the coprocessor (12-*p*) is designed to process the data present on the local bus (22) and associated with a safety level, encoded within a protocol defined as safe (SIL 1, SIL 2), this data, after its processing, is transferred via the processor (10-*p*) to the communication network of train (5);

the processor (10-*p*) is designed to process the data present on the local bus (22) associated with an SIL 0 safety level; this data, after its processing, is transferred directly to the train communication network (5).

5. The architecture according to claim 1, wherein the peripheral processing unit (6) comprises on a single board (7):

a single main processor (10-*p*) designed to process data associated with a zero safety level, SIL 0;

a first interface (16-*p*) designed to enable the connection between the main processor (10-*p*) and the external communication network (5) of the train;

a further interface (30) designed to enable the connection between the main processor (10-*p*) and a local bus (22) interconnected with a plurality of INPUT/OUTPUT units (24).

6. The communication network architecture (1) according to claim 5, wherein the processor (10-*p*) is configured so that:

if the processor (10-*p*) receives data associated with an SIL 1, SIL 2 safety level coming from said local bus (22), this data is transferred, without processing, from the processor (10-*p*) to the train communication network (5).

7. A communication architecture (1) of a train in which at least one central processing unit (3, Main Board) arranged in a train carriage is interconnected through a communication network (5) of the train with a plurality of peripheral processing units (6, I/O Collector Board); the communication network (5) of the train extends along the carriages that form a railway convoy; the communication network (5) of the train being able to transmit both data associated with an SIL 1 and an SIL 2 safety level and data with SIL 0 safety level;

wherein the central processing unit (3) is provided with a single board (7) which includes:

a processor (10) designed to process data associated with an SIL0 safety level;

a coprocessor (12) designed to process only data associated with an SIL1-SIL2 safety level;

an internal bus (14) built on the board (7) and configured to allow a two-way data communication between the processor (10) and the coprocessor (12);

interface means (16) designed to enable connection between said processor (10) and the communication network (5) of the train;

said coprocessor (12) being designed to be programmed in a reconfigurable manner with a software (18) that allows the validation and encoding of data coming from the processor (10) according to a safety protocol;

said coprocessor (12) also being configured to transfer the validated and encoded data to the processor (10) for the subsequent transmission on the communication network (5) of the train (5), wherein the peripheral processing unit (6) has a similar structure to that of the central processing unit (3) and comprises on a single board (7):

a main processor (10-*p*) designed to process data associated with a zero safety level, SIL0;

a coprocessor (12-*p*) designed to process only data associated with an SIL 1 or an SIL 2 safety level;

an internal bus (14-*p*) built on the board (7) and configured to enable a two-way data communication between the main processor (10-*p*) and the coprocessor (12-*p*);

an interface (16-*p*) designed to enable the connection between the main processor (10-*p*) and the external communication network (5) of the train.

8. The architecture (1) according to claim 7, wherein the coprocessor (12-*p*) of the peripheral unit (6) is provided with an interface (20) for the connection with a local bus (22) communicating with a plurality of INPUT/OUTPUT units (24) for the two-way data exchange between the INPUT/OUTPUT units (24) and the coprocessor (12-*p*).

9. The architecture according to claim 8, wherein the INPUT/OUTPUT units (24) are provided with actuators designed to command electrical quantities and parameters on a respective carriage and are provided with an interface designed to transform the information transmitted on the local bus (22) into the (digital/analogue) signal of the actuator.

10. The architecture according to claim 7, wherein the INPUT/OUTPUT units (24) are provided with sensors designed to detect quantities and parameters detected on a respective carriage and are provided with an interface designed to transform the (digital/analogue) signal of the sensor into a format designed to be transmitted on the local bus (22).

11. A communication architecture (1) of a train in which at least one central processing unit (3, Main Board) arranged in a train carriage is interconnected through a communication network (5) of the train with a plurality of peripheral processing units (6, I/O Collector Board); the communication network (5) of the train extends along the carriages that form a railway convoy; the communication network (5) of the train being able to transmit both data associated with an SIL 1 and an SIL 2 safety level and data with SIL 0 safety level;

wherein the central processing unit (3) is provided with a single board (7) which includes:

a processor (10) designed to process data associated with an SIL0 safety level;

a coprocessor (12) designed to process only data associated with an SIL1-SIL2 safety level;

an internal bus (14) built on the board (7) and configured to allow a two-way data communication between the processor (10) and the coprocessor (12);

interface means (16) designed to enable connection between said processor (10) and the communication network (5) of the train;

said coprocessor (12) being designed to be programmed in a reconfigurable manner with a software (18) that allows the validation and encoding of data coming from the processor (10) according to a safety protocol;

said coprocessor (12) also being configured to transfer the validated and encoded data to the processor (10) for the subsequent transmission on the communication network (5) of the train (5), wherein the peripheral processing unit (6) has a structure similar to that of the central processing unit (3) and comprises on a single board (7):

a main processor (10-*p*) designed to process data associated with a zero safety level, SIL0;

a coprocessor (12-*p*, Safe Function Coprocessor) designed to process only data associated with an SIL 1 or an SIL 2 safety level;

an internal bus (14-*p*) built on the board (7) and configured to enable a two-way data communication between the main processor (10-*p*) and the coprocessor (12-*p*);

a first interface (16-*p*) designed to enable the connection between the main processor (10-*p*) and the external communication network (5) of the train;

a second interface (26) allowing the connection between the main processor (10-*p*) and a plurality of INPUT/OUTPUT units (24) for two-way data exchange.

12. The architecture according to claim 11, wherein the main processor (10-*p*) of the peripheral processing unit (6) is configured to receive data with SIL0 and SIL1, SIL2 safety levels from the INPUT/OUTPUT units (24) via the local bus (22); the data with SIL1, SIL2 safety level is transmitted from the processor (10-*p*) to the coprocessor (12-*p*) without any data processing; this data is only transferred from the processor (10-*p*) to the coprocessor (12-*p*) which verifies the validity of the received data, processes the safety functions, packages the data inside a safety protocol and transmits it to the train communication network (5) via the processor (10-*p*).

* * * * *